US005230190A

United States Patent [19]

Schuette

[11] Patent Number: 5,230,190

[45] Date of Patent: Jul. 27, 1993

[54] JOIST BRIDGE AND DUCT SUPPORT

[75] Inventor: Gail Schuette, Watertown, Minn.

[73] Assignee: Empak, Inc., Chanhassen, Minn.

[21] Appl. No.: 956,929

[22] Filed: Oct. 5, 1992

[51] Int. Cl.[5] ..... E04C 2/52

[52] U.S. Cl. ..... 52/220.1; 52/693; 248/57

[58] Field of Search ..... 52/459, 696, 693, 695, 52/317, 220; 248/74.1, 57; 285/64; 137/362, 343

[56] References Cited

U.S. PATENT DOCUMENTS 682,086 9/1901 Kearney .
2,103,064 12/1937 Clark .
2,965,342 12/1960 Golstone .
3,163,386 12/1964 Collins .
3,892,378 7/1975 Lane .
4,122,647 10/1978 Kovar .
4,246,736 1/1981 Kovar .
4,361,999 12/1982 Sidney .
4,630,424 12/1986 Eberle et al. ..... 52/693
4,746,066 5/1988 Kitchens .
4,794,746 1/1989 Ramer .

FOREIGN PATENT DOCUMENTS 2039582 8/1980 United Kingdom ..... 52/693

*Primary Examiner*—Rodney M. Lindsey
*Attorney, Agent, or Firm*—Haugen and Nikolai

[57] ABSTRACT

A joist bridge and duct support device for spanning parallel spaced apart joists or other longitudinally extending parallel spaced apart support beams. The device is integrally formed with a centrally located duct support member within a joist bridge frame member. The joist bridge and duct support member additionally has feet members for ease in placing and securing the bridge to the joists or support beams between which it spans. The joist bridge and duct support member provides a optimum load bearing capacity as a joist bridge while additionally providing duct support.

12 Claims, 1 Drawing Sheet

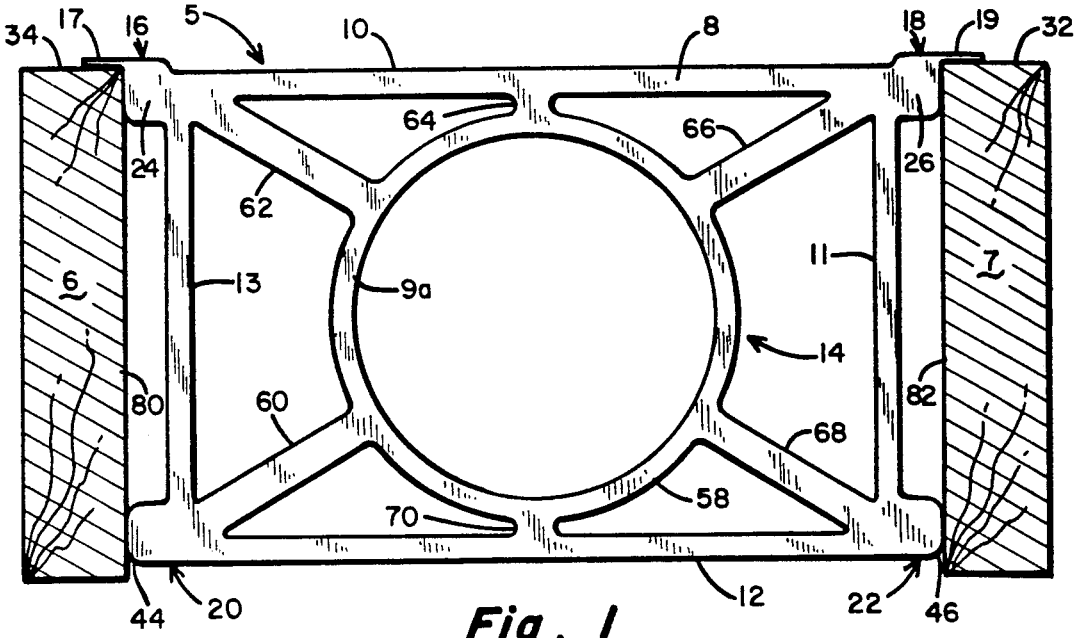
Fig. 1
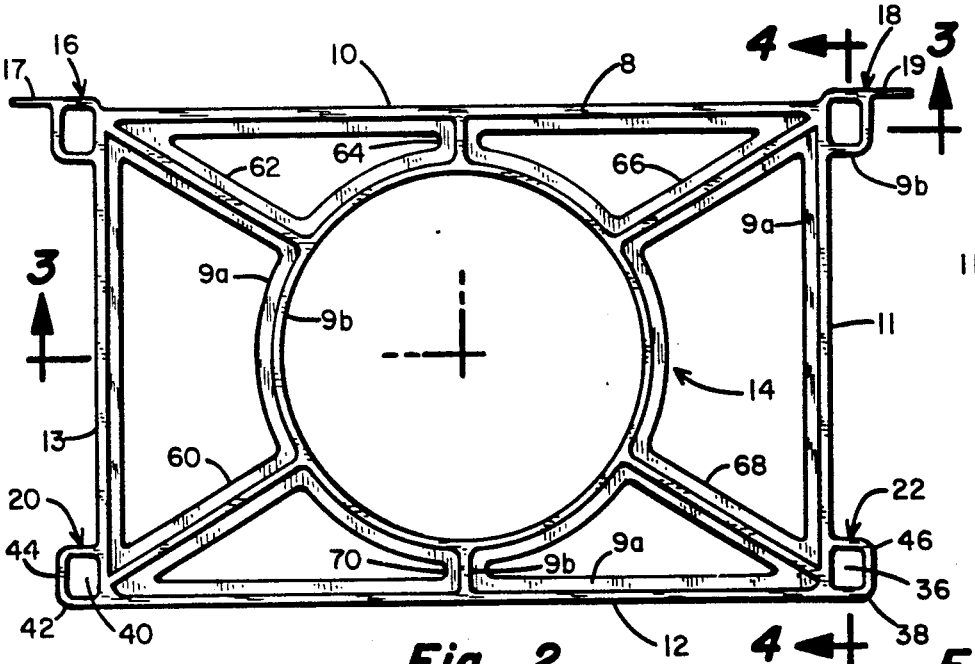
Fig. 2
Fig. 4
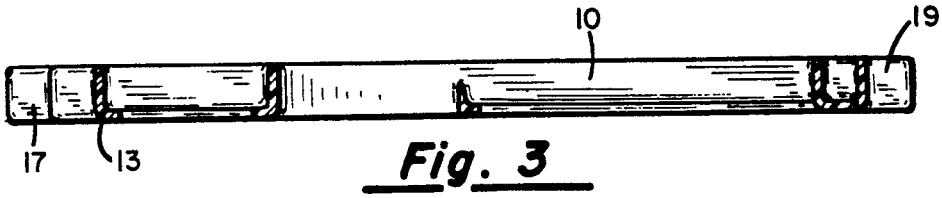
Fig. 3

JOIST BRIDGE AND DUCT SUPPORT

FIELD OF THE INVENTION

The invention relates to a joist bridge and more particularly to a joist bridge which has an opening through which a pipe or duct can extend and be supported.

BACKGROUND OF THE INVENTION

Joist bridges are commonly used in construction for maintaining the load bearing capacity of joists or other parallel support structure beams. Joist bridges are designed to span the distance between two adjacent parallel joists or other parallel structure beams for transfer loads throughout the surrounding joists. Joist bridges also prevent lateral deflection and warping of the joists which can decrease load bearing.

A conventional joist bridge structure comprises an X shape. The X shape is made from adjacent diagonal pieces of lumber spanning between two adjacent joists and nailed to the joists metal diagonal arms spanning the distance between two have also been used as a joist bridge. However, the X configuration prohibits ducts or pipes from extending between joists or other parallel support structure beams. As a result, the X joists must be removed or ducts, pipes and the like must be located below the joists occupying additional space.

Another approach is to have a single bar type brace member extend between the joists which will not inhibit a duct or pipe as shown by U.S. Pat. No. 4,246,736 to Kovar and U.S. Pat. No. 4,361,999 to Sydney. Although these single bar type brace members allow duct and piping to be located alongside the joists, they do not provide optimal support for the joists or other parallel support structure beams.

Most conventional joist bridge structures require nailing or the like means of securing the joist bridge. Securing the joist bridge by nails or the like is time consuming as the joist bridge must be secured at the top and the bottom or on both sides as in single bar brace members.

Therefore, what is needed is a joist bridge which permits ducts and piping to be located alongside the joists without compromising the load bearing capacity of the joists and requiring no nailing to secure the joist bridge.

SUMMARY OF THE INVENTION

The present invention is a joist bridge having generally rectangular body. The rectangular body has a frame portion located in the center for supporting ducts, pipes, and the like. The frame portion is supported by arms extending to the four corners of the generally rectangular body. The top portion of the body has first and second feet extending on opposing sides. Located on the lower portion of the frame body, opposite the first and second feet are a first and second shoulder extending from the generally rectangular frame member. These two feet have faces which are parallel with the joists and abut the joists. Compression fit of the primary floor on the joist bridge first and second feet will secure the bridge. No nailing is required although staples may be used on the first and second feet for additional securing. However, the use of staples is not an essential requirement for securing the joist bridge of the present invention.

Therefore, it is a primary object of the invention to provide a joist bridge which provides optimum support while allowing a duct or pipe to extend through the bridge adjacent to the surrounding joists.

Another object of the present invention is to provide a joist bridge which is easy to insert between the joists.

Yet another object of the invention is to provide an integrally formed joist bridge and duct support.

Still another object of the invention is to provide a joist bridge secured by the compression fit of the primary floor on its first and second feet and, therefore, not requiring nailing to the parallel joists.

These and other objects of the present invention will become more readily apparent from the following detailed description taken in conjunction with the accompanying drawings in which:

DESCRIPTION OF THE DRAWINGS

FIG. 1 is a front plan view of the present invention shown spanning two adjacent parallel joists;

FIG. 2 is a back plan view of the present invention;

FIG. 3 is a cross section taken along line 3—3;

FIG. 4 a cross section taken about line 4—4; and

DETAILED DESCRIPTION OF THE PREFERRED EMBODIMENT

The present invention is a joist bridge and duct support, 5, for spanning the distance between two parallel spaced apart joists or other longitudinally extending parallel support beams, 6 and 7, as shown in FIG. 1. It consists of a generally rectangular body 8 with a duct support frame 14, outward extending feet 16 and 18, and shoulders 20 and 22. The joist bridge is integrally formed preferably from a molded resin such as high density polyethylene (HDPE). A plastic joist bridge eliminates squeaking in the floor caused by two wood objects moving against each other.

The joist bridge and duct support has a configuration of two intersecting perpendicular walls. As shown in FIGS. 2, 3 and 4, 9*a* designates the wall having a first orientation and 9*b* designates the wall oriented 90 degrees from wall 9*a*. This perpendicular configuration provides added structural strength to the joist bridge and duct support. Thus, the entire frame structure has a t-shaped configuration formed by these perpendicular walls 9*a* and 9*b*.

The rectangular body has walls 10, 11, 12 and 13. A first Foot 16 extends outward from the intersection of walls 10 and 13, and a second foot 18 extends outward from the intersection of walls 10 and 11. Each foot has a flange, 17 and 19, respectively. Web 24 extends between wall 13 and foot 16 and web 26 extends Wall 11 and foot 18 to provide additional structural support and load bearing capability. The feet extend perpendicular to the longitudinally aligned joists so that the flanges will lie on the top surfaces 32 and 34 of the joists as shown in FIG. 1.

Walls 11 and 13 have a first and second extending shoulder 20 and 22. Shoulders 20 and 22 are located opposite the first and second feet 16 and 18. Shoulder 20 has face 40 attached to a square wall portion 38. Likewise, shoulder 22 has face 36 attached to a square wall portion 42. The square wall portions of the two shoulders are integral members of the perpendicular wall 9*b*. The faces 36 and 40 of the shoulders are integral members of the perpendicular wall 9*a*. FIG. 3 shows a cross section of the square wall portion and faces 26 and 40. The shoulders 20 and 22 abut the joists when in position.

Wall 44 of shoulder 20 and wall 46 of shoulder 22 will contact the joists as shown in FIG. 1.

Duct support frame member 14 is shown as annular ring 58 located in the center of the rectangular body 10. The duct support is not limited to an annular shape. Rectangular, square or the like shapes which allow commonly used ducts and pipes to pass therethrough and be supported are also applicable. The duct support frame 14 is supported by support arms 60, 62, 64, 66, 68 and 70. The location of the support arms will provide support as a bridge structure in addition to supporting the duct or pipe extending through the duct support member. Arms supporting other frame configurations must not detract from the load carrying and load distribution characteristics of the joist bridge and surrounding joists.

In use, the joist bridge and duct support 5 is inserted between two adjacent parallel joists or other longitudinally spaced support beams 6 and 7 forming a compression fit. Feet 16 and 18 are placed on the top of the joists or support beams to contact surfaces 32 and 34. Nailing, stapling or other forms of securing the feet to the joists is unnecessary because the primary flooring will provide a compression fit to secure the joist bridge. Walls 44 and 46 of the shoulders will contact the sides 80 and 82 of the joists or parallel support beams shown in FIG. 1. It is not necessary to secure the shoulders to the joists or support beams because if lateral deflection occurs, the faces 44 and 46 already abut the joists or support beams and will prevent further lateral deflection. The joist bridge and duct support 5 is now in position. Pipes or ducts can now be inserted through the duct support 14 with no need for removing the joist bridge. Additionally, the plastic joist bridge and duct support eliminates squeaking in the floor caused by two like wood materials moving against each other.

It is understood that the above disclosure and presently preferred embodiment is to be taken as illustrative of the invention. It is to be understood that those skilled in the art be capable of making modifications without departing from the true spirit and scope of the invention.

What is claimed is:

1. A joist bridge integrally formed for interconnecting spaced parallel arranged longitudinal structural members and supporting ducts and pipes said joist bridge comprising:

(a) a generally rectangular frame body member having a first and second end;

(b) a frame portion, said frame portion located in said generally rectangular frame body member for supporting ducts and pipes;

(c) means on said first end of said generally rectangular frame body for joining s id frame body to said spaced parallel arranged longitudinal structural members; and (d) means on said second end of said generally rectangular frame member for contacting said frame member to said spaced parallel arranged longitudinal structural members.

2. The joist bridge of claim 1 wherein said means o said first end is first and second foot members on opposing sides of said first end.

3. The joist bridge of claim 1 wherein said means on said second end comprises first and second shoulders on opposing sides of said second end of said generally rectangular frame member.

4. The joist bridge of claim 2 wherein said first and second feet extend from said generally rectangular frame member so as to perpendicularly contact the longitudinally disposed structural members.

5. The joist bridge of claim 3 wherein said first and second shoulders extend from said generally rectangular from member to contact the longitudinally disposed structural members in a parallel manner.

6. The joist bridge of claim 1 wherein said joist bridge is made from a high density polyethylene (HDPE).

7. The joist bridge of claim 1 wherein said joist bridge can compression fit between said spaced parallel arranged longitudinal structural members and an overlaying flooring.

8. A joist bridge integrally formed for interconnecting spaced parallel arranged longitudinal structural members and supporting ducts and pipes said joist bridge comprising:

(a) a generally rectangular frame body member comprised of two perpendicular walls having a first and second end;

(b) an annular frame portion comprised of two perpendicular walls, said annular frame portion located in said generally rectangular frame body member for supporting ducts and pipes;

(c) a first and second foot member on opposing sides of said first end of said generally rectangular frame body for placing said frame body on said spaced parallel arranged longitudinal structural members;

(d) a first and second shoulder on opposing sides of said second end of said generally rectangular frame member for contacting said frame member to said spaced parallel arranged longitudinal structural members.

9. The joist bridge of claim 8 wherein said first and second foot members extend from said generally rectangular frame member so as to perpendicularly contact the longitudinally disposed structural members.

10. The joist bridge of claim 8 wherein said first and second shoulder extend from said generally rectangular frame member to contact the longitudinally disposed structural members in a parallel manner.

11. The joist bridge of claim 8 wherein said joist bridge is made from a high density polyethylene (HDPE).

12. The joist bridge of claim 8 wherein said joist bridge can compression fit between sad spaced parallel arranged longitudinal structural members and an overlaying flooring.

* * * * *

UNITED STATES PATENT AND TRADEMARK OFFICE

CERTIFICATE OF CORRECTION

PATENT NO. : 5,230,190

DATED : July 27, 1993

INVENTOR(S) : Gail Schuette

It is certified that error appears in the above-identified patent and that said Letters Patent is hereby corrected as shown below:

Column 3, line 55, "s id" should read --said--.

Column 4, line 3, "o" should read --on--.

Column 4, line 56, "sad" should read --said--.

Signed and Sealed this

Twenty-ninth Day of March, 1994

*Attest:*

*Attesting Officer*

BRUCE LEHMAN

*Commissioner of Patents and Trademarks*